US010126006B2

(12) United States Patent
Moreau et al.

(10) Patent No.: US 10,126,006 B2
(45) Date of Patent: Nov. 13, 2018

(54) CYLINDER FOR STORING COOLANT, AND HEAT EXCHANGER INCLUDING SUCH A CYLINDER

(75) Inventors: Laurent Moreau, Versailles (FR); Christophe Voidie, Cormontreuil (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 565 days.

(21) Appl. No.: 14/234,682

(22) PCT Filed: Jul. 24, 2012

(86) PCT No.: PCT/EP2012/064496
§ 371 (c)(1),
(2), (4) Date: Apr. 9, 2014

(87) PCT Pub. No.: WO2013/014152
PCT Pub. Date: Jan. 31, 2013

(65) Prior Publication Data

US 2014/0231279 A1 Aug. 21, 2014

(30) Foreign Application Priority Data

Jul. 25, 2011 (FR) ..... 11 56754

(51) Int. Cl.
*F24F 5/00* (2006.01)
*F25B 39/04* (2006.01)
*F25B 43/00* (2006.01)

(52) U.S. Cl.
CPC ..... *F24F 5/0007* (2013.01); *F25B 39/04* (2013.01); *F25B 43/003* (2013.01); *F25B 2339/0441* (2013.01); *F25B 2400/162* (2013.01)

(58) Field of Classification Search
CPC .. F28F 21/00; F28F 21/02; F28F 27/00; F28F 27/02; F28F 2265/12; F28F 9/231;
(Continued)

(56) References Cited

U.S. PATENT DOCUMENTS 5,787,563 A * 8/1998 Jenkins ..... B60R 21/268 219/91.2
6,209,348 B1 * 4/2001 Shinmura ..... F25B 39/04 165/110

(Continued)

FOREIGN PATENT DOCUMENTS

EP 1 291 592 A1 3/2003
EP 1 310 760 A1 5/2003
EP 1 386 653 A1 2/2004

OTHER PUBLICATIONS

International Search Report for Application No. PCT/EP2012/064496 dated Aug. 31, 2012, 5 pages.

(Continued)

*Primary Examiner* — Len Tran
*Assistant Examiner* — Hans Weiland
(74) *Attorney, Agent, or Firm* — Howard & Howard Attorneys PLLC

(57) ABSTRACT

The invention relates to a cylinder for storing coolant, with which a heat exchanger of an air-conditioning circuit is to be provided, said cylinder defining a first cavity (2) accommodating a desiccator, and a second cavity (3) capable of enabling fluid communication with said circuit. Said cylinder is configured such that said first (2) and second (3) cavities remain isolated from each other up to a first inner pressure threshold, and are placed in fluid communication once said second cavity (3) is subjected to a second inner pressure threshold that is greater than the first threshold. The invention also relates to a condenser provided with such a cylinder.

11 Claims, 2 Drawing Sheets

(58) Field of Classification Search
CPC ..... F28F 9/246; F28F 2220/00; F28F 9/0231; F28D 2021/0084; F16K 17/16; F16K 17/40; F16K 13/04; B01D 35/147; F25B 2339/0441
See application file for complete search history.

(56) References Cited

U.S. PATENT DOCUMENTS 7,712,330 B2 * 5/2010 Hosokawa ..... F25B 39/04 62/474
7,784,302 B2 * 8/2010 Jung ..... F25B 39/04 62/474
2004/0123735 A1 * 7/2004 Watanabe ..... B01D 53/02 95/90
2005/0126214 A1 * 6/2005 Knecht ..... F25B 43/003 62/509
2005/0268643 A1 * 12/2005 Forster ..... F25B 39/04 62/474
2006/0123837 A1 * 6/2006 Shah ..... F25B 39/04 62/509
2006/0162375 A1 * 7/2006 Forster ..... F25B 39/04 62/509
2006/0254310 A1 * 11/2006 Kamsma ..... F25B 39/04 62/509
2008/0314075 A1 * 12/2008 Wolk ..... F25B 39/04 62/509

OTHER PUBLICATIONS

English language abstract and machine-assisted English translation for EP 1 310 760 extracted from espacenet.com database on May 22, 2014, 17 pages.
English language abstract and machine-assisted English translation for EP 1 386 653 extracted from espacenet.com database on May 22, 2014, 34 pages.

* cited by examiner

CYLINDER FOR STORING COOLANT, AND HEAT EXCHANGER INCLUDING SUCH A CYLINDER

RELATED APPLICATIONS

This application is the National Stage of International Patent Application No. PCT/EP2012/064496, filed on Jul. 24, 2012, which claims priority to and all the advantages of French Patent Application No. FR 11/56754, filed on Jul. 25, 2011, the content of which is incorporated herein by reference.

The present invention relates to a cylinder acting as a reservoir for refrigerant and to a heat exchanger, notably a condenser, comprising such a cylinder.

The invention finds a particularly advantageous application in the field of motor vehicle air conditioning.

BACKGROUND

In general, air conditioning circuits need to comply with a certain number of strict requirements regarding the ambient conditions in which the refrigerant, such as the fluid known by the designation R134A, circulates.

This is because it is necessary to avoid too many foreign bodies or foreign bodies of excessive size being present in the circuit as these can generate problems that can go so far as to break certain components of the air conditioning circuits, such as the compressor.

Furthermore, the refrigerant needs to be able to circulate in a moisture-free environment, because water molecules have a tendency to produce acid compounds in the presence of R134A and oil. Such compounds then attack the components of the circuit, and this may give rise to leaks and loss of functionality.

It is known practice to equip air conditioning circuits with cylinders containing a certain quantity of refrigerant in the liquid phase. These cylinders act, firstly, as fluid reservoirs intended to compensate for any potential leaks in the circuits and, secondly, to guarantee that, on leaving the cylinders, the refrigerant is completely in the liquid phase before it is transported further downstream. In particular embodiments, the outlet on the cylinder is led into a section of the condenser to make the liquid refrigerant undergo an additional pass, referred to as supercooling.

It is also known practice to benefit from the presence of reservoir cylinders in the path followed by the refrigerant to solve the environment problems mentioned hereinabove. To do that, a filter and a desiccant are placed inside the cylinders in order to eliminate as far as possible the presence of foreign bodies and moisture in the refrigerant circulation loops.

There are two broad categories of cylinder, namely cylinders referred to as added-on cylinders and cylinders referred to as inbuilt cylinders.

Added-on cylinders come already fitted with a filter and a desiccant. They are assembled with the condenser as a finishing operation, using screws and O-ring seals. However, while this type of cylinder has the advantage of being removable, it nonetheless demands a costly dedicated assembly operation.

Inbuilt cylinders are ready-assembled with the condenser and undergo the brazing process used for assembling the condenser.

If desiccant is present in the cylinder at the time of brazing, the desiccant will undergo a degassing which poses problems. Thus, an opening is provided on inbuilt cylinders through which opening the filter and the desiccant can be inserted inside the cylinders as a finishing operation, the opening being closed by a removable plug. It is also possible with this solution to change the filter and the desiccant at will without having to change the entire condenser.

In order to reduce manufacturing costs and the risks of leaks which are inherent in the sealing system using O-ring seals and removable plugs, there are advantages to be had in using sealed inbuilt cylinder systems.

Such sealed inbuilt cylinder systems are known, in which the opening for introducing the filter and the desiccant is closed by a cap which is sealed by tungsten inert gas (TIG) welding or by laser welding.

However, this solution is not very attractive in terms of cost, because TIG or laser welding as a finishing operation is relatively involved.

This is why cylinders prefitted with a filter and a desiccant, which are sealed and brazed in a single operation with the condenser when the latter is being brazed have been considered. This solution can prove to be highly economical because there are not other additional operations to be carried out on the condenser once it has left the brazing furnace.

However, one difficulty with this type of solution still remains and lies in the way in which the desiccant behaves during the brazing process. More specifically, at high temperature, this desiccant has a tendency to diffuse, toward the condenser with which it communicates, moisture which contaminates the neutral atmosphere of the furnace and disrupts the brazing operation. This results in leaks in the manufactured condensers and means that this solution cannot be industrialized.

SUMMARY OF THE INVENTION

One solution has been proposed that involves confining the desiccant in part of the cylinder using a metal filter, coated with polyurethane. That allows the contamination caused by the degassing of the desiccant during the process of brazing the condenser to be contained. Once brazing has been performed, the polyurethane disappears allowing the R134A to circulate in contact with the desiccant. However, the parameters that allow control over the disappearance of the polyurethane are complex.

The present invention seeks to improve the situation and to this end proposes a cylinder acting as a reservoir for refrigerant, intended to be fitted to a heat exchanger of an air conditioning circuit, said cylinder defining a first housing accommodating a desiccant and a second housing able to allow fluid communication with said circuit, said cylinder being configured so that said first and second housings remain isolated from one another until a first internal pressure threshold is reached and are placed in fluidic communication once said second housing is subjected to a second internal pressure threshold, higher than the first threshold.

Thus it will be understood that, during the brazing process in which the cylinder is intended to be involved, the desiccant will remain confined within the cylinder, thereby preventing any contamination of the brazing atmosphere with moisture likely to escape as a result of the degassing of the desiccant. By contrast, at the end of the brazing operation, the confinement of the desiccant can be disabled, thereby allowing the latter its desiccant action.

This then provides a solution in which the desiccant remains isolated during brazing and in which, after brazing, the cylinder allows the fluid to circulate in contact with the desiccant. The choice of pressure as a parameter governing the transition from one mode to the other also allows simplified monitoring of the operations.

According to various embodiments which may be considered together or separately:

- said cylinder is made of metal, notably of aluminum or aluminum alloys;
- the cylinder comprises a dividing wall isolating said first and second housings from one another, said dividing wall being designed to yield under pressure;
- the cylinder comprises walls, referred to as lateral walls, separating said first and second housings from the outside, and the dividing wall is formed integrally from the material of one and/or other of said lateral walls;
- said dividing wall has a thickness comprised between 0.07 and 0.7 mm, notably between 0.2 and 0.5 mm;
- said cylinder comprises a first tubular body defining said first housing and a second body defining said second housing, said first tubular body having an open end closed by said second body so that said second body defines said dividing wall;
- the second body has a tubular shape that is open at one of its ends;
- the cylinder comprises a plug for closing the second body, that is brazed to said second body;
- the second body has a first thickness at the dividing wall and a higher thickness at the lateral wall of the cylinder;
- the first and second bodies are of substantially circular cross section and have substantially the same diameter;
- said first body and/or said second body are formed by impact extrusion;
- said cylinder comprises a bead of welding between said first body and said second body.

The invention also relates to a heat exchanger, notably a condenser, comprising a cylinder as described hereinabove. In said exchanger, said dividing wall may be burst, particularly after the exchanger has been pressure tested.

The description which will follow, with reference to the attached drawings given by way of nonlimiting examples, will make it easy to understand what the invention consists in and how it may be embodied.

DETAILED DESCRIPTION

Figure 1:
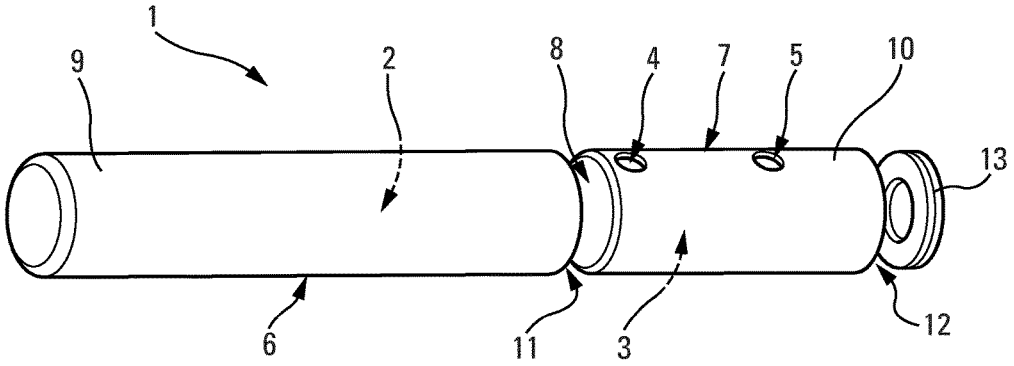
FIG. 1 is an exploded perspective view of an example of a cylinder according to the invention.
Figure 2:
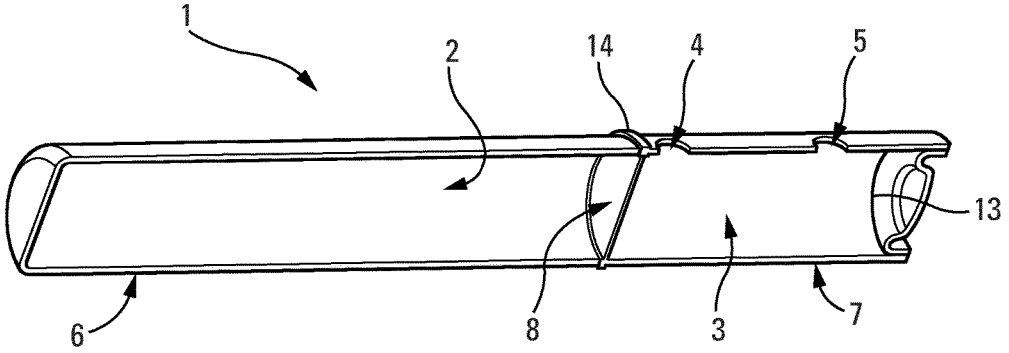
FIG. 2 is a perspective view, on a diametral plane of section, of the cylinder of FIG. 1, illustrated assembled.

As illustrated in FIGS. 1 and 2, the invention relates to a cylinder 1 acting as a reservoir of refrigerant, which cylinder is intended to be fitted to a heat exchanger of an air conditioning circuit, notably a condenser.

Said cylinder 1 defines a first housing 2 accommodating a desiccant, not depicted, and a second housing 3 able to allow fluid communication with said air conditioning circuit, notably via two, inlet/outlet, orifices 4, 5. Said housings 2, 3 are in the prolongation of one another along the longitudinal axis of the cylinder.

According to the invention, said cylinder 1 is configured so that said first 2 and second 3 housings remain isolated from one another until a first internal pressure threshold is reached and are placed in fluidic communication once said second housing 3 is subjected to a second internal pressure threshold, higher than the first threshold.

Said first internal pressure threshold corresponds, for example, to a pressure higher than the differential pressure likely to be encountered between said first housing 2, designed to be subject to phenomena of diffusion of the desiccant under the effect of the heat given off by a brazing operation in which the cylinder is involved, and said second housing 3, designed to be subjected to the brazing atmosphere.

Said second internal pressure threshold corresponds, for example, to a pressure-test pressure such as the pressure used for the helium leak tests carried out on condensers.

During brazing, the desiccant therefore remains confined in the first housing 2. After the pressure test, it is, by contrast, in the fluid circuit, the latter being able to pass from said second housing 3 to said first housing 2.

Said cylinder 1 notably comprises walls 6, 7, referred to as lateral walls, separating said first 1 and second 2 housings from the outside, and a dividing wall 8, isolating said first 1 and said second 2 housing from one another. Said dividing wall 8 is designed to yield under pressure, as will be expanded upon in conjunction with FIG. 3.

Said dividing wall is, for example, formed as an integral part from the same material as one 6 and/or the other 7 of said lateral walls. This then yields a cylinder that is particularly simple, with no added-on component for defining the solution that allows the desiccant to be kept isolated during brazing.

Said dividing wall 8 has, for example, a thickness comprised between 0.07 and 0.7 mm, notably between 0.2 and 0.5 mm.

On that subject, said cylinder may be made of metal, for example of aluminum or aluminum alloys.

Said cylinder 1 notably comprises a first tubular body 9 defining said first housing 2 and a second body 10 defining said second housing 3. Said first tubular body 9 has an open end 11 closed by said second body 10 so that said second body 10 defines said dividing wall 8.

The second body 10 may likewise be tubular in shape, open at one 12 of its ends. The cylinder 1 may incidentally comprise a plug 13 that closes the second body 10, and is brazed to said second body 10 at said open end 12 thereof.

Said second body 10 has said inlet/outlet orifices 4, 5 for the fluid. In this instance they are situated on the lateral wall 7 thereof. A filter, not depicted, may be placed inside said second body 10, between said orifices 4, 5.

The second body 10 may have at least two different thicknesses; a first thickness like the one mentioned above at the dividing wall 8, and a greater thickness at its lateral wall 7. This may be a thickness of 1 to 2 mm, notably 1.5 mm, the thickness of the dividing wall 8 then, for example, being 0.4 mm.

The first 9 and second 10 bodies are of substantially circular cross section here and have substantially the same diameter. They are formed, for example, by impact extrusion. They may be connected by a bead of welding 14, obtained using TIG, MIG, laser or some other welding method.

Figure 3:
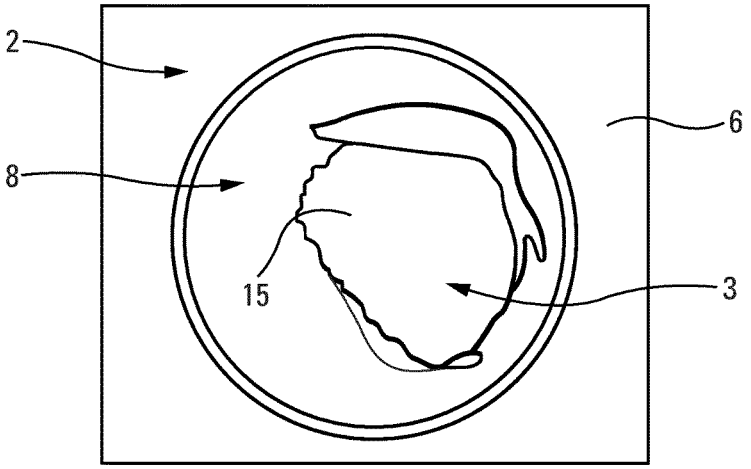
FIG. 3 is a view illustrating the dividing wall of the cylinder of the preceding figures, once it has burst.

As illustrated in FIG. 3, said dividing wall 8, having been subjected to a pressure that exceeds the second pressure threshold, has burst. This figure shows how material has been torn away creating a passage orifice 15 in said dividing wall 8, allowing the first housing 2 and the second housing 3 to communicate. It will thus be appreciated that before said second pressure threshold is applied, the first housing 2 is isolated and protected from diffusion originating from the desiccant whereas, after said second pressure threshold or a higher pressure has been applied, said first housing 2 is connected to the second housing 3 by the creation of said passage orifice 15 between said housings 2, 3.

Figure 4:
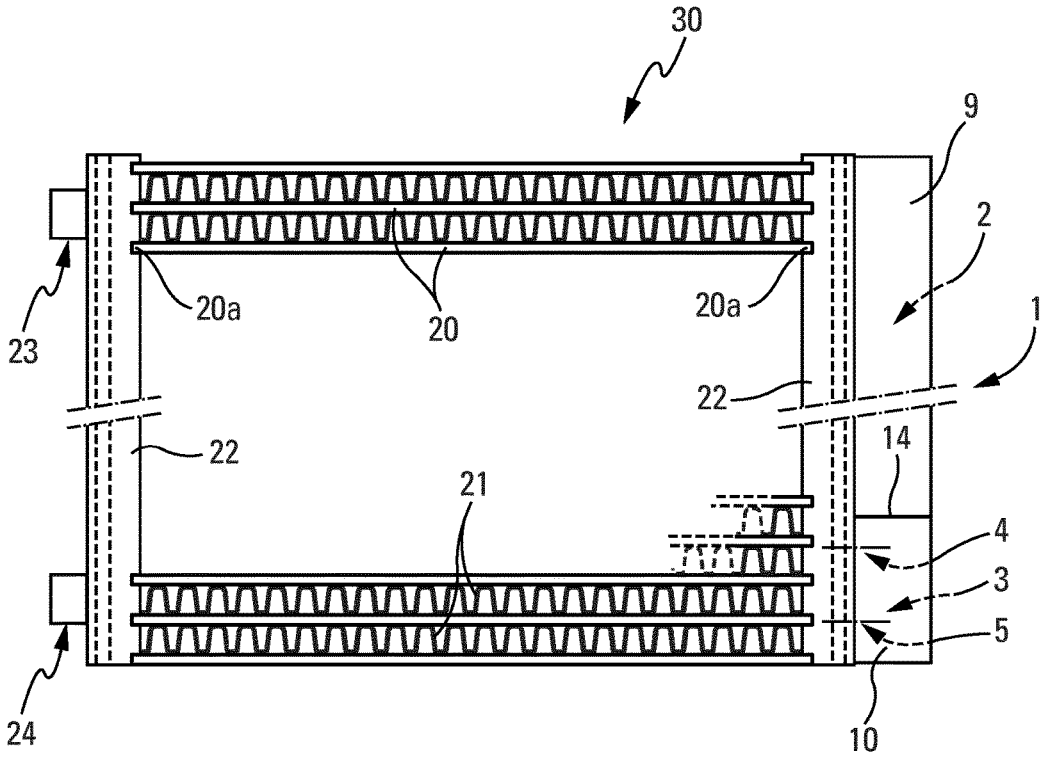
FIG. 4 is a schematic view illustrating face-on one example of a condenser according to the invention.

As illustrated in FIG. 4, the invention also relates to a heat exchanger, notably a condenser, equipped with a cylinder 1 as described hereinabove.

It comprises a core bundle 30 of tubes 20 for the circulation of the fluid and of inserted spaces 21 situated between the tubes 20. It further comprises headers 22 into which the tubes 20 open via their ends 20*a*. The headers 20 here are fitted with inlet/outlet flanges 23, 24.

The cylinder 1 is situated parallel to one of the headers 22. The condenser allows fluid to circulate between the cylinder 1 and the adjacent header 22, for example via inlet/outlet orifices 4, 5 of said cylinder 1 such that the condenser here offers a supercooling pass.

In the preassembled condenser prior to brazing, the dividing wall 8 of the cylinder 1 is fluidtight. It is configured to remain fluidtight during brazing. It is also configured to be burst after brazing, for example under the effect of a pressure test at the pressure of said condenser. It thereby allows the first and second housings 2, 3 of said cylinder 1 to be placed in communication.

The invention claimed is:

1. A cylinder that is a reservoir for a refrigerant for a heat exchanger of an air conditioning circuit, said cylinder comprising:

a first tubular body defining a first housing accommodating a desiccant, a second tubular body defining a second housing able to allow fluid communication with said circuit, first and second lateral walls separating said first and second housings from an outside of the first and second housings, and a dividing wall isolating said first and second housings from one another, wherein said dividing wall yields under pressure and wherein said dividing wall is formed as an integral part from a same material as the first and/or the second lateral walls;

at least one inlet and at least one outlet defined in said second tubular body and disposed on the same side of said dividing wall;

said cylinder being configured so that said first and second housings remain isolated from one another until a first internal pressure threshold is reached, wherein said first and second housings are placed in fluidic communication once said second housing is subjected to a second internal pressure threshold higher than the first internal pressure threshold, and wherein said first and second tubular bodies each have a substantially circular cross section and each have substantially the same diameter.

2. The cylinder as claimed in claim 1, wherein said first tubular body has an open end closed by said second tubular body so that said second tubular body defines said dividing wall.

3. The cylinder as claimed in claim 2, in which the second tubular body is open at one of its ends.

4. The cylinder as claimed in claim 2, comprising a plug for closing the second tubular body, wherein said plug is brazed to said second tubular body.

5. The cylinder as claimed in claim 2, in which the second tubular body has a first thickness at the dividing wall and a higher thickness at the second lateral wall of the cylinder.

6. The cylinder as claimed in claim 2, in which said first tubular body and/or said second tubular body are formed by impact extrusion.

7. The cylinder as claimed in claim 2, comprising a bead of welding between said first tubular body and said second tubular body.

8. The cylinder as claimed in claim 1, in which said dividing wall has a thickness between 0.07 and 0.7 mm.

9. A heat exchanger comprising the cylinder as claimed in claim 1.

10. The heat exchanger as claimed in claim 9, wherein said dividing wall is burst.

11. The cylinder as claimed in claim 1, in which said dividing wall has a thickness between 0.2 and 0.5 mm.

* * * * *